United States Patent [19]

Riggs, Jr.

[11] 4,413,408

[45] Nov. 8, 1983

[54] METHOD FOR FABRICATING ELECTRODES

[75] Inventor: Olen L. Riggs, Jr., Bethany, Okla.

[73] Assignee: Kerr-McGee Chemical Corporation, Oklahoma City, Okla.

[21] Appl. No.: 361,582

[22] Filed: Mar. 24, 1982

[51] Int. Cl.[3] ..... H01R 43/00

[52] U.S. Cl. ..... 29/825; 29/464; 204/196; 204/197; 403/296

[58] Field of Search ..... 29/825, 526 R, 464; 204/196, 197; 403/292, 296, 361

[56] References Cited

U.S. PATENT DOCUMENTS

| | | | |
|---|---|---|---|
| 2,947,680 | 8/1960 | Preiser | 204/197 |
| 3,075,911 | 1/1963 | Anderson | 204/196 |
| 3,313,721 | 4/1967 | Teel | 204/196 |
| 3,488,274 | 1/1970 | Geld | 204/196 |
| 3,550,270 | 12/1970 | Watson, Jr. et al. | 29/464 X |

FOREIGN PATENT DOCUMENTS

| | | | |
|---|---|---|---|
| 1047030 | 12/1966 | United Kingdom | 204/196 |
| 1135056 | 11/1968 | United Kingdom | 204/196 |
| 1386720 | 3/1975 | United Kingdom | 204/196 |

*Primary Examiner*—Mark Rosenbaum
*Assistant Examiner*—Carl J. Arbes
*Attorney, Agent, or Firm*—William G. Addison

[57] ABSTRACT

This invention relates to a method for preparing an improved electrode comprised of titanium and platinum joined to one another in such manner as to resist separation by corrosion when utilized in a cathodic protection system in a corrosive environment such as in a shell and tube heat exchanger.

3 Claims, 3 Drawing Figures

METHOD FOR FABRICATING ELECTRODES

BACKGROUND OF THE INVENTION

1. Field of the Invention

The present invention relates to a method for fabricating improved electrodes. More particularly, the present invention relates to a method for fabricating electrodes suitable for use as part of a cathodic protection system in corrosive environments such as, for example, in shell and tube heat exchangers.

2. Description of the Prior Art

In general, in fabricating shell and tube heat exchangers, the shell and tubes are made from carbon steel and type 316 stainless steel is used for the sheets mounted inwardly and at either end of the shell for supporting the tubes.

Particularly, when brackish water is employed as the heat exchange medium in such exchangers, it has been observed that current flows from the more active carbon steel to the more passive stainless steel. In such a situation, iron within the carbon steel oxidizes to the ferrous ion with the loss of two electrons in accordance with the following equation:

$$Fe^0 \xrightarrow{\text{oxidize}} Fe^{+2} + 2e^-.$$

The net result of this electro conduction is corrosion and wearing away of the carbon steel. Such corrosion occurs in those regions where the tubes pass through openings in the supporting sheets with the consequent wearing away of the sheet and the dislocation of the tubes.

In the past, attempts have been made to avoid or at least substantially minimize such corrosion by utilization of cathodic protection systems.

In one such system, titanium rods have been mounted in the dished ends of the shell and tube heat exchangers and electrically connected to the shell of the heat exchanger to provide a cathodic protection system. The titanium anodes have had platinum patches welded thereto for the purpose of current "values." Such titanium electrodes have served as the anode in the system with the inner walls of the dished ends of the exchanger serving as the cathode. Unfortunately, in commercial operation, it has been determined that the platinum patches have a relatively short life. While the mechanism for this is not fully understood it is believed that, in operation, the skin voltage on the titanium anode becomes more active than the titanium base in the weld area causing the weld to disintegrate and release the platinum patch into the dished ends of the heat exchanger.

The base titanium metal has an extremely positive "skin" voltage ranging anywhere from 4–12 volts and when the patch is welded on to this titanium the titanium weld area has a much more active "skin" voltage and is less corrosion resistant. Being less corrosion resistant, the weld area is easily corroded, permitting the platinum patch to be removed prematurely from the anode.

SUMMARY OF THE INVENTION

The surprising discovery now has been made that, in accordance with the present invention, it now is possible to fabricate platinum-titanium electrodes by a new method to provide electrodes suitable for use in heat exchangers, which process obviates completely the need for welding the platinum patch to the titanium rods.

More particularly, in accordance with the present invention, an electrode is prepared by milling one end of a titanium rod to thereby adapt it to receive, by slip fit, a thin walled platinum cylinder. The inner portion of the milled end of the rod is drilled and tapped to receive a titanium bolt to secure the platinum cylinder on the end of the titanium rod.

DESCRIPTION OF THE PREFERRED EMBODIMENT

Figure 1:
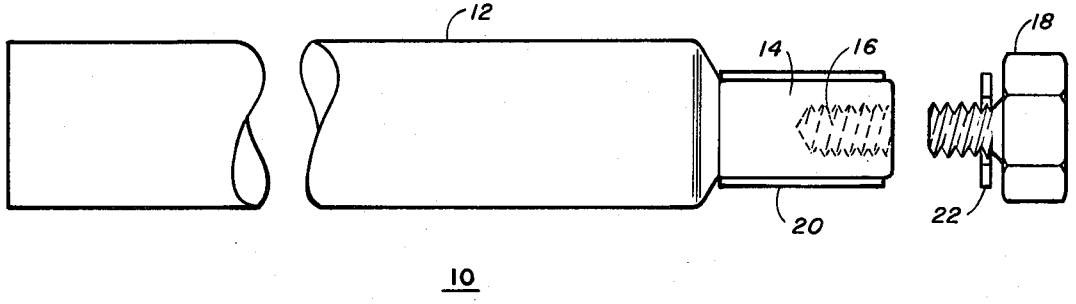
FIG. 1 is a schematic illustration of the novel electrode fabricated in accordance with the process of the present invention.

Turning to FIG. 1, an electrode 10, fabricated in accordance with the process of this invention, is illustrated. The electrode 10 comprises a titanium rod 12, one end 14 of which is milled, as illustrated in FIG. 1. A hole 16 is drilled and tapped in the inner portion of end 14 so as to be adapted to receive a locking bolt 18, also made of titanium. A platinum cylinder 20 is fabricated in such a manner as to be adapted to be positioned on to the milled end 14 and secured thereto in a slip fit manner.

Prior to positioning the platinum cylinder 20 about the milled end 14 of the titanium rod 12, the rod is cooled (by inserting it in, for example, ice water) to approximately 0°–10° C. Thereafter, the platinum cylinder 20 is slipped over the milled end 14 of the titanium rod 12. As the rod is permitted to return to ambient temperature, it swells to secure the cylinder about the end of the rod.

Thereafter, locking bolt 18, together with a surrounding lock washer 22, is inserted into hole 16 and screwed into place to removably lock the platinum cylinder 20 about the milled end 14 of titanium rod 12.

Figure 2:
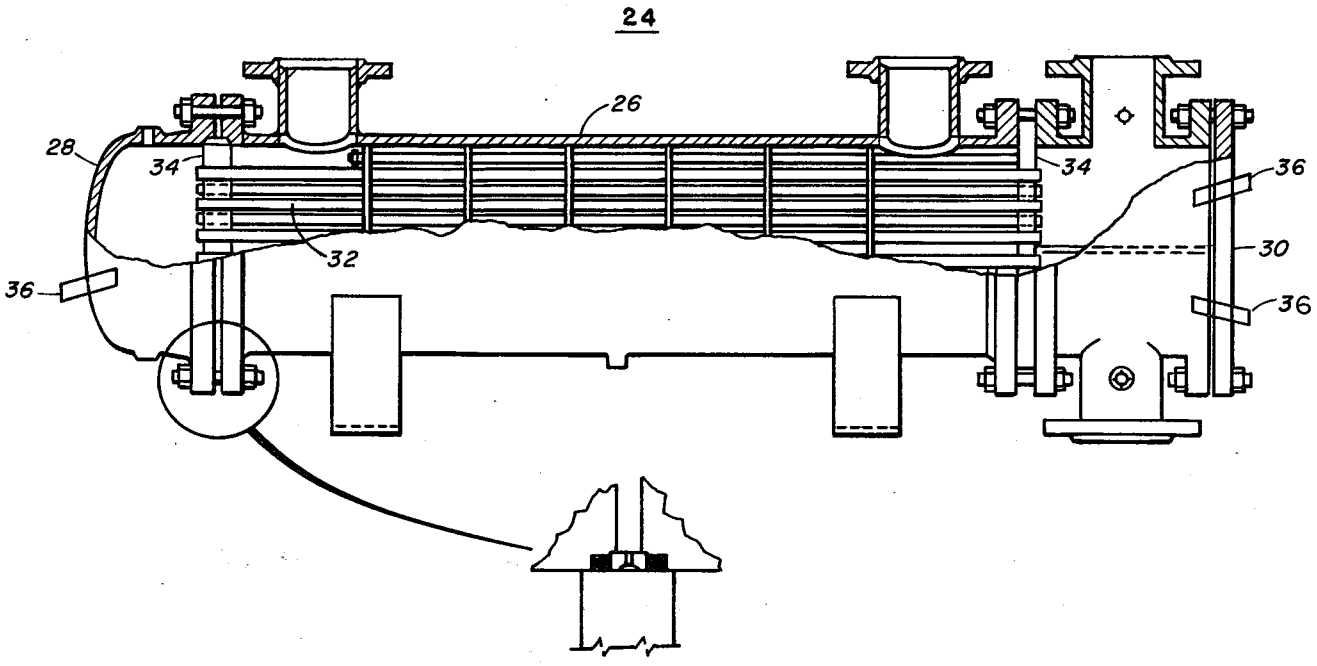
FIG. 2 is a schematic illustration of a shell and tube heat exchanger incorporating improved electrodes prepared in accordance with the process of the present invention.

FIG. 2 is a schematic illustration of a shell and tube heat exchanger 24 equipped with a cathodic protection system utilizing the novel electrodes fabricated in accordance with the process of the present invention.

The exchanger 24 has a side wall or shell 26, dished end walls 28 and 30, and a plurality of tubes 32 supported within the inner shell by sheets 34. Reference numeral 36 refers, in general, to the anode fabricated in accordance with the novel process of this invention, mounted in the dished end walls 28 and 30 in association with the electrical system utilized in the cathodic protection system.

Figure 3:
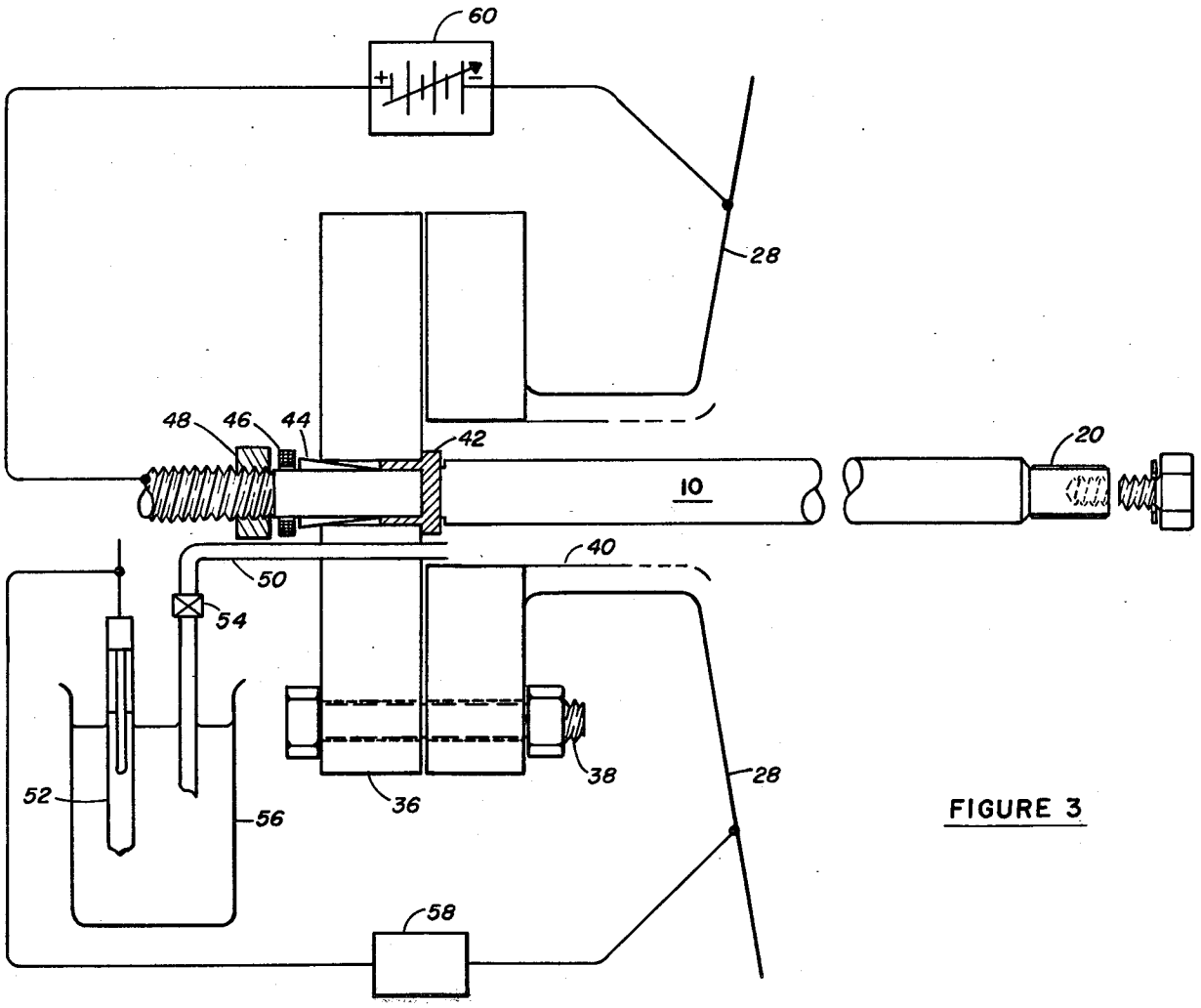
FIG. 3 is a schematic, detailed, illustration of an anode fabricated in accordance with the process of the present invention, mounted in one end of a heat exchanger and connected to a standard Calomel reference electrode.

A more detailed illustration of the anode fabricated in accordance with the present invention, its installation in the dished end walls 28 and 30 and the cathodic protection system, is illustrated schematically in FIG. 3.

End wall 28 is flanged to mate with a plate 36 secured to one another by bolt 38. The flange and plate 36 are provided with an opening 40 in which anode 10 is mounted. The end of the anode opposite the end with the platinum cylinder 20 is provided, successively, with a Teflon insulator 42, a compression plug 44, a Teflon washer 46 and a titanium locking nut 48 to cooperatively mount the anode within the opening 40.

A tube 50 passes outwardly from the interior of the exchanger 24 to operatively communicate with a Calomel standard reference electrode 52.

Utilizing the foregoing apparatus and equipment, cathodic protection is imparted to the carbon steel parts within the heat exchanger 24 in the following manner: brackish waters from within the exchanger is withdrawn through tube 50 at a rate controlled by valve 54 into a beaker 56. The reference electrode 52 mounted in beaker 56 is connected to a millivolt meter 58 which, in turn, is connected to the outside of the shell of the heat exchanger. The millivolt meter 58 indicates the desired reference potential, permitting the operator to regulate the output voltage in the impressed current rectifier 60 to cause current to flow sufficient to shift the potential with reference to the standard reference electrode 52 to the cathodic protection potential required. The impressed current rectifier 60 has as one part of its electrical circuit the titanium anode 10 which is attached as the positive connection and the other part which completes the electrical circuit of the shell 28 of the heat exchanger which is attached as the negative connection. Operators use the reference electrode to determine the proper voltage required of the rectifier 60 to ensure passage of sufficient current to provide cathodic protection against carbon steel corrosion within the heat exchanger.

It has been determined that after a number of months of commercial operation electrodes, fabricated in accordance with the process of the present invention, have an extremely long life and provide cathodic protection to the heat exchanger in a most efficacious manner. Electrodes provided with platinum patches welded thereto had a commercial life of only about four to eight weeks whereas electrodes fabricated in accordance with the process of the present invention have operated successively for periods in excess of 40 weeks.

While the present invention has been described with respect to what is believed to be the preferred embodiment thereof, it will be understood, of course, that certain changes and modifications may be made therein without departing from the true scope of the appended claims.

What is claimed is:

1. In the process of fabricating electrodes for use in cathodic protection systems installed in corrosive atmospheres such as heat exchangers, such electrodes employing titanium and platinum, the improvements which comprise:

a. mill one end of a titanium rod;

b. drill and tap a hole in the inner portion of said milled end;

c. slip fit a platinum cylinder about the milled end of said titanium rod and d. secure the platinum cylinder about the milled end of the titanium rod by inserting a titanium locking bolt into said drilled and tapped hole.

2. A process as set forth in claim 1 in which at least the milled end of said titanium rod is cooled to a temperature of approximately 0°–10° C. before said platinum cylinder is applied thereto.

3. The process of claim 2 in which the platinum cylinder is slipped over the cooled milled end of the titanium rod and the resulting assemblage is permitted to return to ambient temperature.

* * * * *